United States Patent [19]

Ng et al.

[11] Patent Number: 4,762,764

[45] Date of Patent: Aug. 9, 1988

[54] LIQUID DEVELOPER

[75] Inventors: Dominic S. Ng, Toronto; Raymond W. Wong, Mississauga; Melvin D. Croucher, Oakville, all of Canada

[73] Assignee: Xerox Corporation, Stamford, Conn.

[21] Appl. No.: 946,548

[22] Filed: Dec. 23, 1986

[51] Int. Cl.[4] ..... G03G 9/12

[52] U.S. Cl. ..... 430/115; 430/137

[58] Field of Search ..... 430/112, 115, 137

[56] References Cited

U.S. PATENT DOCUMENTS

| | | | |
|---|---|---|---|
| 3,363,863 | 12/1968 | Veillette et al. | 430/115 |
| 3,554,946 | 1/1971 | Okuno | 430/115 |
| 3,623,986 | 11/1971 | Nachida | 430/114 |
| 3,890,240 | 6/1975 | Hockberg | 430/115 |
| 3,900,412 | 8/1975 | Kosel | 430/114 |
| 4,374,918 | 2/1983 | Veillette et al. | 430/115 |
| 4,473,629 | 9/1984 | Herrmann | 430/114 |
| 4,476,210 | 10/1984 | Croucher | 430/114 |
| 4,681,831 | 7/1987 | Larson et al. | 430/114 |

FOREIGN PATENT DOCUMENTS 2065320 6/1981 United Kingdom .

*Primary Examiner*—Roland E. Martin

*Attorney, Agent, or Firm*—Peter H. Kondo

[57] ABSTRACT

A stable colored liquid developer comprising an insulating organic liquid dispersion medium having dispersed therein negatively charged marking particles comprising a thermoplastic resin core substantially insoluble in the dispersion medium, an amphipathic copolymeric steric stabilizer irreversibly anchored to the thermoplastic resin core, the steric stabilizer being soluble in the dispersion medium, a colored dye imbibed in the thermoplastic resin core, the dye being soluble in the thermoplastic resin core and insoluble in the dispersion medium and a charge control agent selected from the group consisting of a polybutene succinimide, lecithin, basic barium petroleum sulfonates, and mixtures thereof. This liquid developer may be employed to develop electrostatic latent images either on dielectric paper or on an electroreceptor or photoreceptor substrate and the resulting toner image may be transferred to another surface by tape transfer.

13 Claims, No Drawings

LIQUID DEVELOPER

BACKGROUND OF THE INVENTION

The present invention relates in general to negatively charged liquid developers and methods of using these liquid developers in electrostatographic imaging systems.

In an electrostatographic imaging process such as, for example, xerography, a xerographic plate containing a photoconductive insulating layer is imaged by uniformly electrostatically charging its surface followed by exposure to a pattern of activating electromagnetic radiation such as light to selectively dissipate the charge in illuminated areas of the photoconductive member to form an electrostatic latent image corresponding to the pattern of activating electromagnetic radiation. This electrostatic latent image may then be developed with a developer composition containing charged marking particles. The resulting marking particle image may, if desired, be transferred to a suitable receiving member such as paper.

Developer compositions may be in dry or liquid form. Conventional commercial liquid developers comprise a dispersion of pigments in a liquid hydrocarbon. Once the electrostatic latent image is formed on a photoconductive imaging member, it is transported through a bath of the liquid developer. When in contact with the liquid developers, the charged pigment particles in the liquid developer migrate to the electrostatic latent image and deposit thereon in conformance with the image. The photoconductive member may then be withdrawn from the liquid developer bath with the marking particles adhering to the electrostatic latent image in image configuration. A thin film of residual developer normally remains on the surface of the electrophotographic imaging member.

In their earliest applications, liquid developers took the form of pigment particles such as carbon black, which were dispersed in a petroleum distillate and had a charge applied thereto with a charge control agent such as a metal salt. The problem with the earliest liquid developers existed in their dispersion stability in that upon being stored for any extended period of time, the carbon black pigment would tend to flocculate and settle out of the dispersion medium as non-redispersable macroscopic material at the bottom of the vessel. In an attempt to overcome this difficulty, a dispersant such as polyisobutylene which is soluble in the carrier liquid and which would be adsorbed on the carbon black pigment particles, was added in an attempt to provide a steric barrier between the individual particles. In effect, this was an attempt to provide increase dispersion stability by increasing the repulsive interaction between the individual carbon black particles and to provide a more uniform dispersion so that the particles would not settle out. It was believed that the presence of the resin maintained the carbon black as discrete particles over long periods of time by providing a protective coating for the carbon black particles so that the attractive forces between adjacent particles would not come into play. While this was a dramatic improvement over the liquid developers without dispersants that had been used heretofore, the resin coating in some instances tended to desorb from the carbon black particles thereby permitting the attractive forces between adjacent particles to once again come into play. This resulted in individual carbon black particles flocculating and settling to the bottom of the dispersion vessel.

The next step in the evolution of the development of liquid developers involved the use of amphipathic copolymers. For example, instead of the polyisobutylene homopolymer dispersant described above which was soluble in most of the aliphatic hydrocarbons that were used as dispersion vehicles and which also coated the carbon black, an amphipathic block or graft copolymer was selected on the theory that part of the copolymer would have an affinity for the liquid phase, the hydrocarbon liquid, and part of the copolymer would have an affinity for the surface of individual pigment particles. Thus, with the use of such an amphipathic copolymer, part of the copolymer is adsorbed on the carbon black particle surface and binds the insoluble part of the polymer to the particle surface thereby reducing the desorption of the polymer from the carbon black particles. Typical approaches are described in U.K. Pat. No. 3,554,946 (Okuno et al), U.S. Pat. No. 3,623,986 (Machida et al) and U.S. Pat. No. 3,890,240 (Hockberg). Even with this improvement in liquid developers, dispersion stability continued to present a problem in that it was also possible that the stabilizer desorb from the particle surface rendering the developer thermodynamically unstable. The next event in the development of liquid developers involved an attempt to formulate a developer in which desorption of the dispersant was, in effect, theoretically impossible. It was believed that a stable liquid developer would be provided if the particle contained a steric barrier which could not be desorbed from the particle surface. This, of course, is very difficult to do in the chemical sense when one is dealing with a carbon black pigment. The way around this particular difficulty, however, is to chemically make a particle wherein the steric barrier is chemically tied to the particle surface. This is typically accomplished with a non-aqueous dispersion of polymer particles wherein a steric barrier is attached to the polymer surface thereby providing a thermodynamically stable polymer particle. This provides a liquid developer in which the individual marking particles do not flocculate.

The above-described non-aqueous dispersion of polymer particles with a steric barrier attached to the polymer surface is described in detail in U.S. Pat. No. 3,900,412 (Kosel) which is incorporated herein in its entirely. Briefly, Kosel shows the concept of chemically providing a stable developer by forming a polymer core with a steric barrier attached to the polymer surface. The problem that exists with the technique described by Kosel relates to providing a sufficient amount of colorant associated with the marking particle to achieve an acceptable optical density in the developed image. For example, beginning at column 15 of the Kosel patent, a discussion may be found pertaining to imparting color by either using pigments or dyes and physically dispersing them as by ball milling or high shear mixing. Attempts to impart color by ball milling pigments added to the latex were unsuccessful insofar as obtaining a developed image of acceptable optical density. This is because the preferred size of latex particles is 0.2 to 0.3 micrometer in diameter and, with ball milling techniques, it is very difficult to prepare a dispersion of carbon black or other pigment particles much smaller in size than about 0.7 to about 0.8 micrometer. Consequently, for example, the addition of carbon black pigment particles to the relatively small latex particles while ball milling would only result in the relatively small latex particles residing on the surface of the pigment particles. The resulting developer particles are thermodynamically unstable.

A discussion may be found in the Kosel patent regarding the use of dyes as distinguished from pigments in providing color to a liquid developer. While this techique does work to a certain degree, it is still not possible to incorporate sufficient dye in the particles to give an image of acceptable optical density. Furthermore, and more importantly, the use of this approach will increase the level of background deposits because all the dyes described in column 16 and indicated in the Kosel patent to be capable of use in this technique are soluble in the dispersion medium. Since, as described above, the liquid development technique involves substantially uniform contact of the imaging surface with the liquid developer, including the insulating liquid carrier fluid, this fluid must come in contact with the electrostatographic imaging surface and the dye can be readily adsorbed onto the electrophotographic imaging surface, particularly single use zinc oxide photoreceptors, giving rise to increased background deposits in the final copy.

In U.S. Pat. No. 4,476,210 (Croucher et al) a stable color liquid developer is describe comprising an insulating liquid dispersion medium having dispersed therein colored marking particles which comprise a thermoplastic resin core which is substantially insoluble in the dispersion medium, an amphipathic block or graft copolymer steric stabilizer which is chemically or physically anchored to the resin core and which is soluble in the dispersion medium, and a colored dye imbibed in the thermoplastic resin core, the colored dye being dispersable at the molecular level and therefore soluble in the thermoplastic resin core and insoluble in the dispersion medium. In a preferred application, the dispersion medium is an aliphatic hydrocarbon, the amphiphatic steric stabilizer is a graft copolymer of poly (2-ethylhexyl methacrylate) or poly (2-ethylhexyl acrylate) solution grafted with vinyl acetate, N-vinyl-2-pyrrolidone or ethyl acrylate and a thermoplastic resin core which is a homopolymer or copolymer of vinyl acetate, N-vinyl-2-pyrrolidone or ethyl acrylate. The entire disclosure of U.S. Pat. No. 4,476,210 is incorporated herein by reference. Although positive or negative charging of dyed particles is mentioned in column 10, lines 35 and 37, all the specific formulations described in U.S. Pat. No. 4,476,210 are positively charged ink formulations which use zirconium octoate as the preferred charge control agent. The ink formulations in U.S. Pat. No. 4,476,210 were found to charge positively using a large variety of well known charge control agents including metal soaps. These formulations were aimed primarily at electrographic printing applications where the latent image is created by discharge of metal stylii. In this technology negatively charged latent images have traditionally been favoured because historically it has been easier to obtain stable positively charged liquid development inks than negatively charged liquid development inks. More recent ion stream deposition techniques lay down a positively charged latent image rather than a negatively charged latent image because stable positively charging corona devices are more readily available and more reliable than negatively charging corona devices. Also chalcogenide based photoreceptors, including migration imaging members (XDM), provide for a positively charged latent image to be toned. This has led to a need for negatively charged liquid inks and numerous examples of negatively charged carbon black based inks can be found in the patent literature. No specific examples of acceptable negatively charged latex based inks have been described to date.

At the present time the mechanism of electrostatically charging particulate matter in dielectric fluid is poorly understood from a scientific viewpoint, consequently it remains an intuitive process. In the case of carbon black based liquid development inks the charging appears to be caused by the interaction of the charge control agent with specific surface chemical groups on the carbon black. In the case of latex based liquid development inks such as described in U.S. Pat. No. 4,476,210, the surface characteristics which are important to charging are complicated since there is a resin core with a dye imbibed within this resin. The interaction of a specific dye and the resin makes it impossible to predict the effect of a charge control agent a priori.

PRIOR ART STATEMENT

U.S. Pat. No. 3,900,412 to Kosel issued Aug. 19, 1975—A liquid toner composition is disclosed comprising amphiphatic polymeric molecules of the graft type each having a polymeric backbone part and a polymeric graft part on the backbone part, a dye or pigment, liquid carrier, and a charge director. Examples of disclosed charge directors include OLOA 1200 and soya bean lecithin.

U.S. Pat. No. 4,476,210 to Croucher et al issued Oct. 9, 1984—A stable color liquid developer is disclosed comprising an insulating liquid dispersion medium having dispersed therein colored marking particles which comprise a thermoplastic resin core which is substantially insoluble in the dispersion medium, an amphipathic block or graft copolymer steric stabilizer which is chemically or physically anchored to the resin core and which is soluble in the dispersion medium, and a colored dye imbibed in the thermoplastic resin core, the colored dye being dispersable at the molecular level and therefore soluble in the thermoplastic resin core and insoluble in the dispersion medium. Positive or negative charging of dyed particles is mentioned in column 10, lines 35 and 37.

UK Patent Application No. GB 2 065 320 to Nashua, published June 24, 1981—A negative liquid developer is disclosed comprising an carrier liquid containing latex particles comprising a major amount of a $C_1$-$C_6$ lower alkyl acrylate or methacrylate polymer, a pigment system, a charge control agent consisting of a copolymer of $C_2C_6$ lower alkyl vinyl ether and a vinyl chloride, and an acrylic polymer gel.

U.S. Pat. No. 3,363,863 to Veillette et al issued Dec. 14, 1982—A developer is disclosed comprising an organic carrier containing latex particles, a pigment system, a charge control agent consisting of a copolymer of $C_2$–$C_6$ lower alkyl ether and a vinyl chloride, and an acrylic polymer gel for stabilizing the dispersion.

U.S. Pat. No. 4,374,918 to Veillette et al issued Feb. 22, 1983 —A negative developer is disclosed comprising an organic carrier, a pigment, a stabilizing gel on the borderline of solubility in the carrier, a latex which imparts a fixative function to the developer, and a two component charge control agent. The charge control agent consists of a first polymer having a basic character and a second polymer having an acid character.

U.S. Pat. No. 4,473,629 to Herrmann et al issued Sept. 25, 1984 —A liquid developer is disclosed containing negatively charged toner particles comprising a carrier liquid, a pigment or dye constituent, a resinous binder, a charge controller and conventional additives.

Japanese Patent Publication No. J5 7139-754 to Ricoh, published Aug. 28, 1982—A liquid developer is disclosed comprising a negatively charged toner containing a pigment or dye and resin dispersed in a carrier liquid, the pigment being a quinophthalone.

Japanese Patent Publication No. J5 7128-3350 to Dainippon Ink Inst Chem, published Aug. 9, 1982—A negatively charged developer is disclosed containing a graft polymer, dye and/or pigment and insulating carrier liquid.

Japanese Patent Publication No. J5 7128-348 to Canon, published Aug. 9, 1982—A negatively charged toner is disclosed containing a binder resin, C. I. Disperse Yellow 164, and colloidal silica.

U.S. Pat. No. 3,554,946 to Okuno et al, issued Jan. 12, 1971—A liquid developer preparation techniques is disclosed a pigment and a copolymer resin polarity control agent such as acrylate or methacrylate copolymers are kneaded either independently or together with a surface active agent in a hydrocarbon carrier liquid.

U.S. Pat. No. 3,623,986 to Machida et al, issued Nov. 30, 1971—A liquid developer is disclosed a pigment consisting essentially of a carrier liquid and a toner of pigment particles coated with a homopolymer prepared from monomers having an epoxy radical or carbinol radical. The homopolymer may be graft copolymerized with the pigment particles.

U.S. Pat. No. 3,890,240 to Hockberg, issued Jun. 17, 1975—A toner composition is disclosed containing a carbon black pigment dispersed in a hydrocarbon fluid containing a dissolved acrylic terpolymer together with a dye or pigment adsorbed on or associated with the carbon black, and a surface active agent.

Thus, there is a need for improved liquid developer compositions containing negatively charged toner marking particles for developing positively charged electrostatic latent images and obtaining reversal images on negatively charged electrostatic imaging members. Moreover, there is a need for improved liquid developer compositions containing negatively charged toner marking particles which can be readily transferred from a imaging surface to an adhesive surface. Accordingly, there is a need for further improved liquid developer compositions containing negatively charged toner marking particles.

SUMMARY OF THE INVENTION

Accordingly, it is an object of the present invention to provide an improved liquid developer and process for imaging with the developer which overcomes the problems encountered with the prior art developers.

It is a further object of the present invention to provide an improved liquid developer which exhibits a stable negative charge.

It is a further object of the present invention to provide an improved liquid developer which readily transfers to an adhesive surface.

It is a further object of the present invention to provide an improved liquid developer which has substantially improved color characteristics and optical density because the colorant is molecularly dissolved in the core of the particles.

It is a further object of the present invention to provide an improved liquid developer which provides for a substantially reduced level of background deposits of marking material.

It is a further object of the present invention to provide an improved liquid developer which provides for a liquid developer with greatly improved dispersion stability of the marking particles.

A further object of the present invention resides in the provision of negatively charged liquid developers which are useful in a variety of reproduction processes inclusive of electrostatic imaging systems, electrographic recording, electrostatic printing, fascimile printing and the like.

The above objects and others are accomplished in accordance with the present invention by providing a stable colored liquid developer comprising an insulating organic liquid dispersion medium having dispersed therein negatively charged marking particles comprising a thermoplastic resin core substantially insoluble in the dispersion medium, an amphipathic copolymeric steric stabilizer irreversibly anchored to the thermoplastic resin core, the steric stabilizer being soluble in the dispersion medium, a colored dye imbibed in the thermoplastic resin core, the dye being soluble in the thermoplastic resin core and insoluble in the dispersion medium and a charge control agent selected from the group consisting of a polybutene succinimide, lecithin, basic barium petroleum sulfonates, and mixtures thereof. This liquid developer may be employed to develop electrostatic latent images either on dielectric paper or on an electroreceptor or photoreceptor substrate and the resulting toner image may be transferred to another surface by tape transfer.

To ensure a clear understanding of the present invention, certain terms are defined as follows. The expression "sterically stabilized" is defined as a particle which will remain dispersed in the dispersion medium by virtue of the attractive forces between adjacent polymer particles in the dispersion medium being screened by the steric stabilizer on the polymer particles. This steric stabilizer creates its own repulsive interaction between polymer particles which maintains the particles separated from each other. The steric stabilizer may be described as being amphipathic in nature, i.e. a portion of the steric stabilizer has an affinity for one material and another portion has an affinity for another material. In a specific embodiment, the amphipathic stabilizer has a moiety which is solvated by (soluble in) the dispersing liquid and a moiety which is non-solvated by (insoluble in) the dispersing liquid. In a preferred stabilizer, the moiety which is solvated by the dispersing liquid is a poly(alkyl acrylate) or poly(alkyl methacrylate), the alkyl group having at least three carbon atoms such a poly(2-ethyl hexyl acrylate) or poly(2-ethyl hexyl methacrylate), or a poly(isobutylene-co-isoprene) copolymer (Kalene 800 from Hardman Company, NJ) and a moiety which is non-solvated by the dispersion medium such as poly(N-vinyl-2-pyrrolidone), poly(vinyl acetate) or poly(ethyl acrylate). Amphipathic block copolymers such as poly (styrene-b-hydrogenated butadiene) available as Kraton G1701 from the Shell Chemical Company, Houston, TX, is also a good steric stabilizer for these homogeneous dispersions of polymer particles. The part of the stabilizer soluble in the dispersion medium forms a protective barrier on the polymer particles while the non-solvated moiety is absorbed or incorporated into the thermoplastic resin core thereby anchoring the solvated moiety to the resin core. As previously indicated, the dye is "imbibed" into the resin core by which it is believed that the dye is assimilated, bound up or absorbed by the resin core.

The liquid developers may be made with any suitable organic dispersion medium. Typically, the dispersion medium is insulating and has a resistivity greater than about $10^9$ ohm cm and a dielectric constant less than about 3.5 so that it will not discharge the electrostatic latent image. In addition, the dispersion medium typically has a viscosity less than about 2.5 centipoises so that the marking particles may readily move through the dispersion medium. Typical dispersion media are colorless, odorless, non-toxic, and non-flammable with flash points greater than about 104° F. and include aliphatic hydrocarbons. Aromatic liquids are generally not suitable because of their toxicological properties. A particularly preferred group of materials are many of the petroleum distillates that are readily available commercially. Typical of such preferred materials are high-purity isoparaffinic liquids such as Isopar G, Isopar H, Isopar K and Isopar L, available from Exxon. Also included in this group are Amsco 460 Solvent and Amsco OMS, both available from American Mineral Spirits Company. In addition, mineral spirits such as Soltrol available from Phillips Petroleum, Pegasol available from Mobil Oil, and aliphatic hydrocarbon liquids such as Shellsol available from Shell Oil, may be used.

The marking particle which is dispersed in the dispersion medium in the practice of the present invention comprises a synthetic core which is insoluble in the dispersion liquid and which is irreversibly anchored to a solvated steric barrier or stabilizer which is defined as the steric stabilizer attached or bound either physically or chemically to the synthetic resin core such that it cannot leave the synthetic core. In addition, the marking particle has a colored dye imbibed into it and a negative charge transfer agent selected from the group consisting of a polybutene succinimide, lecithin, basic barium petroleum sulfonate, and mixtures thereof.

The marking particles are preferably essentially monodispersed and, therefore, are generally all about the same size and shape and have a relatively narrow size distribution. The non-aqueous dispersion polymerization process by which the particles are made provides for a well controlled particle size distribution. Typically, the size of the particle is on the order of about 0.4 micrometer although the size range may be as broad as from about 0.1 micrometer to about 1.0 micrometer as determined from transmission electron micrographs and using a Coulter Nanosizer. The monodispersed nature is preferred in providing substantially uniform charge on each particle or uniform charge to mass ratio of the developer and thereby insuring more accurate response of the negatively charged marking particles to the electrostatic latent image.

Any suitable thermoplastic resin may be used as the core of the marking particle. Typical thermoplastic resins include materials which are capable of non-aqueous dispersion polymerization as hereinafter described, insoluble in the dispersion medium, and include poly(methyl acrylate), poly(methyl methyacrylate), poly(ethyl methacrylate), poly(hydroxyethyl methacrylate), poly(2-ethoxyethyl methacrylate), poly(butoxy ethoxyethyl methacrylate), poly(dimethyl amino ethyl acrylate), poly(acrylic acid), poly(methacrylic acid), poly(acrylamide), poly(methacrylamide),poly(acrylonitrile),poly(vinyl chloride) and poly(ureido-ethyl vinyl ether). A preferred group of materials are the homopolymers of vinyl acetate, N-vinyl-2-pyrrolidone, ethyl acrylate, and copolymers thereof. Thermoplastic resins selected from the group consisting of vinyl, acrylic and methacrylic resins are preferred resins for the core of the marking particles. The mechanical properties of the marking particle may be altered or varied by the selection of the polymer used for the core of the particle. For example, using poly (vinyl pyrrolidone) as a core polymer provides a hard particle which retains its spherical shape on drying. On the other hand, poly(ethyl acrylate) particles coalesce on drying to form a film. This enables either opaque or transparent developers to be prepared and allows control of the thermomechanical properties that are essential for both transfer and direct liquid development.

The amphipathic stabilizer which is irreversibly anchored to the synthetic resin core may be of any suitable material. Typically, the synthetic resin involves a graft or block copolymer having a moiety with an affinity for or being solvated by the dispersion medium and having another moiety having an affinity for the synthetic resin core. Preferably, the amphipathic stabilizer has a molecular weight in the range of from about 10,000 to about 100,000. Lower molecular weights of less than about 10,000 generally provide an insufficient steric barrier for the core particles so that they tend to flocculate. Molecular weights above about 100,000 are usually unnecessary and uneconomical. Preferably, the amphipathic polymer comprises a soluble polymer backbone having a nominally insoluble anchoring chain grafted onto the backbone. Alternatively, the steric stabilizer may comprise an AB or ABA type block copolymer. Typical block copolymers include poly(vinyl acetate-b-dimethyl siloxane), poly(styrene-b-dimethyl siloxane), poly(methyl methacrylte-b-dimethyl siloxane), poly(vinyl acetate-b-isobutylene), poly(styrene-b-2ethylhexyl methacrylate), poly(ethyl methacrylate-b-2-ethylhexyl methacrylate), poly(dimethylsiloxane-b-styrene-b-dimethylsiloxane),poly(styrene-b-hydrogenated butadiene), and the like.

Typical polymers suggested for use as the soluble backbone portion of the graft copolymer upon which a second polymer may be grafted include polyisobutylene; poly(isobutylene-co-isoprene); polydimethylsiloxane; poly(vinyl toluene), poly(12-hydroxy stearic acid); poly(isobornyl methacrylate); acrylic and methacrylic polymers of long chain esters of acrylic and methacrylic acid such as stearyl, lauryl, octyl, hexyl, 2-ethylhexyl; polymeric vinyl esters of long chain acids such as vinyl stearate, vinyl laurate, vinyl palmitate; polymeric vinyl alkyl ethers including poly(vinyl ethyl ether), poly(vinyl isopropyl ether), poly(vinyl isobutyl ether), poly(vinyl n-butyl ether); copolymers thereof, and the like.

Preferred backbone polymers include poly(isobutylene-co-isoprene), polydimethyl siloxane,poly(2-ethyl hexyl acrylate), poly(2-ethyl hexyl methacrylate), and poly(styrene-b-hydrogenated butadiene).

Typical monomers suggested for use as the insoluble portion of the graft copolymer include vinyl acetate, methyl acrylate, methyl methacrylate, ethyl acrylate, ethyl methacrylate, hydroxy ethyl acrylate, hydroxy ethyl methacrylate, acrylonitrile, acrylamide, methacrylonitrile, methyacrylamide, acrylic acid, methacrylic acid, mono-ethyl maleate, monoethyl fumarate, styrene, maleic anhydride, maleic acid and N-vinyl-2-pyrrolidone. Preferred materials include vinyl acetate, N-vinyl-2-pyrrolidone and ethyl acrylate because they are non-toxic, inexpensive, and readily grafted into a variety of backbone polymers and provide excellent anchoring to the core particle. While, as noted above, the synthetic resin core must be insoluble in the dispersion liquid, the backbone moiety of the amphipathic stabilizer is soluble in the dispersion liquid and imparts colloidal stability to the particle.

The marking particle may be treated with any suitable organic dye to impart color to it. The organic dye is preferably dispersible at the molecular level in the synthetic resin core to provide a molecular dispersion and ensure good distribution since it would otherwise tend to aggregate and give poor color intensity as well as broadened spectral characteristics. Furthermore, the organic dye should be insoluble in the carrier liquid so that once it is imbibed into the resin core it will not diffuse out into the dispersion medium. In addition, insolubility in the dispersion medium ensures that the background deposits will be minimized, since as noted above, the entire imaging surface may be contacted with the liquid developer during development of the electrostatic latent image and the dye cannot deposit on the background areas of the imaging surface if the dye is insoluble in the liquid phase. Moreover, it is preferred that the dye be water insoluble to ensure permanence of the developed image and to avoid dissolving subsequent to development should the image come into contact with water as may frequently be the case in an office environment with coffee, tea and the like. Typical organic dyes include Orasol Blue GN, Orasol Red 2BL, Orasol Blue BLN, Orasol Black GN, Orasol Black RL, Orasol Yellow 2RLN, Orasol Red 2B, Orasol Blue 2GLN, Orasol Yellow 2GLN, Orasol Red G, available from Ciba Geigy, Mississauga, Ontario, Canada; Morfast Blue 100, Morfast Red 101, Morfast Red 104, Morfast Yellow 102, Morfast Black 101, available from Morton Chemical Limited, Ajax, Ontario, Canada; and Savinyl Yellow RLS, Savinyl Yellow 2RLS, Savinyl Pink 6BLS, Savinyl Red 3BLS, Savinyl Red GL5, Savinyl Black RLS available from Sandoz, Mississauga, Ontario, Canada and Neozapon Black X57 from BASF, Toronto, Ontario, and the like.

The developer of this invention, including the synthetic polymer particles, are substantially free of pigment particles. The expression "pigment particles" is intended to be given its usual meaning, e.g. materials such as carbon black. Thus, it is possible that some of the dye utilized in the developer of this invention dissolved in the resin core may precipitate to form undesirable organic pigment particles. These particles are usually removed by filtering the ink after the dyeing step in order to rid the system of any unwanted particulate matter. If the particles manage to pass through the filter, the particles could be a source of background deposits. If the particles possess the correct electrical characteristics and can image, they could be a source of print defects. Preferably, the filters have openings of at least about 1 micrometer. Thus, although minor amounts of precipitated organic pigment particles might remain in the developer, it is only pigment material formed in-situ that could not be readily removed. Consequently, unwanted foreign matter is a source of concern and the developer of this invention should be substantially free of pigment particles. The developer of this invention is considered substantially free of pigment particles when the developer contains less than about 0.1 percent by weight pigment material based on the weight of the entire developer.

Upon standing, the developer particles in liquid inks will slowly settle out under gravitational forces to the bottom of containers. When settling occurs, for example, in carbon black based inks, the steric stabilizer can be displaced from the surface of the particle thereby allowing the particles to flocculate because repulsive forces between the particles no longer operate. This behavior often determines the shelf life of the developer. In the inks of this invention, the stabilizing polymer is terminally (irreversibly) attached to the particle so desorption is not a problem. After settling, such particles may readily be dispersed. Consequently, settling does not lead to ink flocculation and failure in the systems of this invention.

The liquid developer of this invention must include a negative charge control agent to impart a negative charge to the marking particles sufficient to enable the particles to undergo electrophoresis in an electric field through the insulating organic liquid dispersion medium. The negative charge control agent should be soluble in the dispersion medium but must be adsorbed (imbibed) at the particle-fluid interface. It has been found experimentally that the interaction of the dye with the resin core affects both the sign and the magnitude of the electrostatic charge. Consequently, it is only from actual testing of a large number of materials that acceptable negative charge control agents have been discovered for nonaqueous sterically stabilized latex inks. A very limited number of suitable negative charge control agents have been found for negatively charging marking particles comprising a dyed thermoplastic resin core and a copolymer shell surrounding the core. Surprisingly, in the inks tested, the specific stabilizing polymer employed does not appear to play a major roll in charging. Thus, stabilizers may be changed and similar effects are still obtained upon charging. The negative charge control agents in the inks of this invention are selected from the group consisting of polybutene succinimide, basic barium petroleum sulfonate, lecithin, and mixtures thereof. Polybutene succinimide is a succinimide of a thermoplastic isotactic (stereoregular) polymer of isobutene available, for example, as OLOA 1200 and OLOA 374Q from Chevron Chemical Company, San Francisco, CA, and as TC 9596A from Texaco Chemical Company, White Plains, NY. More specifically, OLOA 1200 is believed to be a partially imidized polyamine with lubricating-oil-soluble polyisobutylene chains and free secondary amines characterized by a gravity at 60° F. API 22.9, specific 0.92, flash point by the Cleveland open cup method, 425° F., viscosity at 210° F., 400SSU, color (ASTM D-1500) L55D, nitrogen, percentage by weight 2.0 and alkalinity value, (SM-205-15) 43. OLOA 1200 is described in U.S. Pat. No. 3,900,412 as a negative charge control agent. However, it has been observed that OLOA 1200 can act as a positive charge control agent as well as a negative charge control agent. Thus, it is not obvious to conclude that OLOA 1200 will act strictly as a negative charge control agent. This applies to lecithin and to basic barium petroleum sulfonate as well as to OLOA 1200. Thus, one cannot predict a priori from the nature of the charge control agent what sign it will impart to the particle. It is the interaction of the molecularly dissolved dye in polymer with the charge control agent that is important. Kosel in U.S. Pat. No. 3,900,412 was never able to test this hypothesis because he was unable to effectively dye his particles. Thus, Kosel never specifies whether the charge control agent charges positively or negatively (e.g. see claim 9) and only that he charges the particles. From claim 13 of Kosel, however, it appears that it is the interaction of the charge additive with the chromophore in claim 13 which gives rise to charged particles. All the dyes in claim 26 of Kosel appear to be oil soluble. However, the core of the particles do not like the oil, e.g. Isopar. Consequently the method of Kosel is unable to impart sufficient color to the particles. It is now believed that it is very possibly the interaction of the oil soluble dye with the resin of the core particle and charge control agent that is causing these particles to be charged. In other words, the dye acts as a charge control agent. During testing in the laboratory, it has been found that an undyed latex often acquires the wrong sign of charge when the charge control agent is added to it. It is only when the latex is dyed that it acquires charge of the correct sign and magnitude. All of the marking particles of this invention are negatively charged. Typical lecithin negative charge control agents include vegetable lecithin from Fisher Scientific Company Toronto, Ontario. Soya bean lecithin is described in column 20, line 14 of U.S. Pat. No. 3,900,412. However, as indicated above, there is no recognition in the prior art of the interaction of the oil soluble dye with the resin of the core particle and charge control agent. Basic barium petroleum sulfonate is a naturally occurring alkyl aryl petroleum sulfonate which is obtained from the cracking of crude oil and is available as Barium Petronate B-70 from Witco Chemical Company, New York, NY. These negative charge control agents must be soluble in Isopar solvents, to be able to impart a charge to the particles. All of these specific materials are preferred because they are able to impart a unipolar negative charge to the polymer particles, i.e. there are no positively charged particles in these inks. The criteria that the charge control agent should exhibit is that it must adsorb at the particle-fluid interface to charge the particles. Whether the charging takes place because of the transfer of a proton (acid-base mechanism) or because the adsorption mechanism allows for dissociation of the charge control agent is unknown. Adsorption of the charge control agent at the particle-fluid interface may be detected from conductivity measurements as a function of the concentration of charge control agent that has been added to the dispersion. Generally, the conductivity should be less than about $10^{-10}$ ohm $cm^{-1}$. A preferred negative charge control agent is polybutene succinimide available as Chevron OLOA 1200 because it is insoluble in water and, in the preferred dispersion liquid, imparts a stable negative charge on the marking particles.

When the liquid toners of U.S. Pat. No. 4,476,210 to Croucher et al were synthesized for positively charging toners, it was found that many common charge control agents charged the latex ink positively with little evidence they could be charged negatively. As can be seen from a review of prior art patents such as U.S. Pat. No. 3,363,863 to Veillette et al, UK Patent Application No. G.B. 2 065 320 to Nashua, and U.S. Pat. No. 4,374,918 to Veillette et al, described above, all of the negatively charged toners described in these patents contained a pigment which was usually a carbon black. It is the interaction of materials such as polymers, low molecular weight additives, with the pigment (usually the carbon black surface) that gives the toner its negative charge. In U.S. Pat. No. 4,476,210 such surfaces are not available to cause charging. In charging studies on the latex toners without dye it has been found that many of the materials claimed as negative charge control agents such as OLOA 1200, lecithin and barium petroleum sulfonate charge the latex positively. It is only after dye is imbibed into the particle that the same charge control agent charges the colored latex negatively. Not every dye interacts to charge the latex based ink negatively. Moreover, it is impossible to a priori predict the charge a dyed latex toner will acquire because the mechanism of charging is not well understood. OLOA 1200, lecithin and barium petroleum sulfonate are all soluble in Isopar fluids. Another difference between the developers of the previously described patents and the negatively charged liquid developers of this invention lies in the simplicity of the developer formulations relative to the formulations of the developers of these other patents. For example, the formulation of the liquid developer described in columns 9 and 10 of U.S. Pat. No. 4,363,863 contains six individual components. The interactions between these materials is extremely complex thereby precluding an understanding of how charging occurs in these liquid development inks. The formulation of the liquid developers of this invention comprises a sterically stabilized latex, a dye imbibed in the latex and a charge control additive selected from the group consisting of polybutene succinimide, basic barium petroleum sulfonate, lecithin and mixtures thereof. What cannot be stressed enough is that it is the specific core resin-dye interaction that controls the sign of the charge the particle will acquire with a specific charge control agent. Examples of combinations of particle core resin, dye and charge control agents that form negatively charged latex inks are illustrated in the Table 1:

TABLE I

NEGATIVELY CHARGED LATEX LIQUID INKS

| PARTICLE CORE RESIN | DYE | CHARGE CONTROL AGENTS |
|---|---|---|
| Polyvinyl(N—Vinyl-2-pyrrolidone) | Orasol Blue 2GLN | (1.) Lecithin<br>(2.) Basic barium petroleum sulfonate<br>(3.) Polybutene succinimide |
| Polyvinyl(N—Vinyl-2-pyrrolidone) | Orasol Yellow 2GLN | (1.) Lecithin |
| Polyvinyl(N—Vinyl-2-pyrrolidone) | Orasol Red G | (1.) Basic barium petroleum sulfonate<br>(2.) Polybutene succinimide |
| Polyvinyl(N—Vinyl-2-pyrrolidone) | Orasol Black RL | (1.) Lecithin<br>(2.) Basic barium petroleum sulfonate |
| Poly(vinyl acetate) | Orasol Blue 2GLN | (1.) Lecithin |
| Poly(vinyl acrylate) | Orasol Blue 2GLN | (1.) Lecithin<br>(2.) Basic barium petroleum sulfonate |
| Poly(vinyl acrylate) | Orasol Red G | (1.) Lecithin<br>(2.) Basic barium petroleum sulfonate |

Copolymers of the above of poly(N-vinyl-2-pyrrolidone-co-ethyl acrylate) and poly(N-vinyl-2-pyrrolidone-co-vinyl acetate) also give negatively charged latex liquid inks with mixtures of the above dyes and charge control agents.

It should also be noted that the thermomechanical properties desired of a specific toning process may be built into these particles unlike pigment based particulate inks because the hardness or softness, i.e. the glass transition temperature of the polymer particles is controllable which is not the case for a pigment based ink. In pigment based developers, the pigment has a certain mechanical integrity. Consequently, in order to fix it to paper, a surfeit of soluble polymer is present in the Isopar dispersion medium. The expectation is that this soluble polymer will deposit on paper with the pigment and thereby, upon drying, act as a fixant for the pigment. The polymer particle approach is more elegant in that the core of the polymer particle can be made "soft" if film forming characteristics are desired or "hard" if fusing of the image by heat or transfer of the image from one surface to another by tape transfer is desired. Scientifically, the property of importance is the glass transition temperature ($T_g$) of the polymer core. If a soft film forming polymer particles is desired, a low $T_g$ (i.e. $T_g < 10°$ C.) would be selected whereas a particle which would retain its integrity upon drying would be selected to have a high $T_g$ (i.e. $T_g > 35°$ C.). An advantage of the sterically stabilized polymer particles made in-situ approach is that the mechanical properties of the particle can be tailored to the end application for which it is to be used. This is not possible with pigment based inks.

The liquid developers of the present invention may be made by any suitable technique. One procedure for producing the stabilized, highly colored liquid developer involves first preparing the amphipathic stabilizer in the liquid developer dispersion medium followed by adding, in the presence of a free radical initiator, an excess of a monomer or mixture of monomers from which the synthetic resin core is to be made, followed by polymerizing the monomer to form the synthetic resin. Thereafter, a solution of the dye or mixture of dyes in a polar solvent or mixture of polar solvents is added to the dispersion to imbibe the dye in the core of the marking particle.

During the polymerization procedure, the amphipathic stabilizer becomes intimately bound to the synthetic core. The expression "intimately bound" is intended to mean those chemical as well as physical interactions that irreversibly anchor the amphipathic stabilizer in such a way that it cannot leave the particle under normal operating conditions. Once the stabilized resin core has been made, the dye may be imbibed in it, described hereinafter, and a negative charge control agent is then added to the dispersion. This procedure may be viewed as a four step procedure involving:

(A) preparation of the amphipathic stabilizer, (B) non-aqueous dispersion polymerization of the core monomer in the presence of the amphipathic stabilizer to provide the stabilized particle, (C) dyeing of the non-aqueous dispersion particles, and (D) negatively charging the particles.

The amphipathic stabilizer may be either a block or graft copolymer formed by adding the selected monomers to a solution in the insulating dispersion medium of the backbone polymer. For example, vinyl acetate, N-vinyl-2-pyrrolidone or ethyl acrylate or a mixture of these monomers may be added to a solution of poly(2-ethyl hexyl methacrylate) in Isopar G. The reaction is carried out in the presence of a free radical initiator such as benzoyl peroxide or azo bis isobutyronitrile at atmospheric pressure and at an elevated temperature from about 50° C. to about 90° C. for about 5 hours. The product is a graft copolymer stabilizer. The graft copolymer stabilizer typically comprises a polymer backbone having grafted to it at various positions along its chain, a polymer or copolymer of one or more of the added monomers.

Once the stabilizer in the dispersion medium has been prepared, the synthetic resin core may be made by non-aqueous dispersion polymerization. This is accomplished by adding an excess of a monomer to be polymerized to the solution containing the amphipathic stabilizer which acts as the steric stabilizer during the growth of the polymer particles. This growth takes place in the presence of a free radical initiator at atmospheric pressure and elevated temperatures of from about 60° C. to about 90° C. Over a period of several hours, 1 to 20 hours, the polymer core of the marking particles is grown in the presence of the steric stabilizer with the result that a dispersion is formed of up to about 50 percent by weight of particles having a relatively uniform size of 0.1 micrometer to about 1 micrometer with most of the particles being in the 0.3 to 0.4 micrometer size range. During the growth of the polymer core, the amphipathic polymer functions as a steric stabilizer to keep the individual growing particles separate in the dispersion. If, for example, the dispersion polymerization of the core monomer takes place without the stabilizer, the polymer formed from the monomer will phase separate forming the nucleus of the particle which will then flocculate and settle as sediment in the form of an aggregate. Instead, the polymerization takes place in the presence of the stabilizer which, as previously discussed, becomes irreversibly and intimately bound either chemically or physically to the polymer core being formed, thereby providing a thermodynamically stable particle.

Once the stable dispersion of marking particles has been prepared, it is dyed to provide a core particle capable of producing a toned image of good optical density and color characteristic. The dye is molecularly incorporated into the core particles by using a specific dye imbibition absorption technique. It has been found that polar solvents may be specifically absorbed into the core of the particle produced from the non-aqueous dispersion polymerization procedure and by dissolving a dye into such a polar solvent, the dye is readily imbibed or absorbed into the polymer core. The polar solvent used should be essentially insoluble in the dispersion medium otherwise some of the dye may go into the dispersion medium increasing the possibility of dye deposition in the background areas. Any suitable polar solvent which is absorbed into the core of the marking particle may be employed. It has been found that methanol, glacial acetic acid, ethylene glycol, dimethyl sulfoxide and N,N-dimethyl formamide and mixtures of these solvents perform well. Methanol is preferred as the solvent for the dye because it may be desirable, if not necessary in some instances, to remove the polar absorption fluid from the particles and the methanol can be readily removed by simple heating or distillation. Other suitable techniques may be used to remove the polar solvent from the particles, if desired.

The dyes used should be highly soluble in the polar solvent and insoluble in the dispersion medium. Typical dyes selected from those previously mentioned include Orasol Blue 2GLN, Orasol Yellow 2GLN, Orasol Red G, Orasol Black RL, and the like. Typically, from about 5 percent to about 25 percent, and preferably 10 percent weight/volume solution of the dye is prepared and added drop wise to the dispersion containing from about 2 percent to about 10 percent by weight of marking particles. This imbibition procedure is carried out at elevated temperatures of from about 40° C. to about 60° C. until an acceptable amount of dye has been imbibed or absorbed by the core particles. Typically, this can take from about 2 to about 16 hours depending on the dye, the type of core particle, and the temperature employed. It has been found that this technique is capable of producing stable colored marking particles yielding developed or toned images of superior optical density and color characteristics. After the dye imbibition procedure, the dye solvent, particularly if it is methanol, may be removed by distillation thereby imparting somewhat better image and fixing properties. The concentrate so prepared may then be diluted to from about 4.0 percent to about 0.5 percent by weight of particles by adding more dispersion medium to make the working ink dispersions.

In order for the dyed particles to develop a positively charged electrostatic latent image, the dyed particles must be charged to a negative charge and remain stable for extended periods of time. The negative charge control agent must preferably be soluble in the dispersion medium but must be absorbed at the particle-fluid interface. Some of the adsorbed charge control agent must then (presumably) dissociate imparting a negative charge to the particle. It is also imperative that the charge control agent not dissociate in the Isopar alone to a large degree since the fluid then becomes too conductive and free ions will discharge the latent image. Optimum results are achieved by polyisobutene succinimide (e.g. OLOA 1200, OLOA 374Q, TC 9596A), lecithin, and basic barium petroleum sulfonate (basic barium petronate). Typically, from about 0.1 percent to about 5 percent weight/weight of charge control agent based on the weight of dyed latex solids is employed. The amount of charge control agent added is dependent upon the charge/mass ratio desired for the liquid developer which typically can range from less than 10 microcoulombs per gram to greater than about 1,000 microcoulombs per gram. The charge/mass ratio can be controlled by varying the concentration and the type of charge control agent used with a particular latex.

The liquid developers of the present invention may comprise various constituents in a variety of suitable proportions depending upon on the ultimate end use. While the developers may have a solid content of from about 0.1 to about 2 percent weight/weight, typically from about 0.2 percent to about 0.8 percent weight/weight of particles are used in the dispersion medium. Each particle comprises from about 50 percent to about 98 percent by weight of the polymer core and from about 50 percent to about 2 percent by weight of amphipathic stabilizer. The polymer core typically contains from about 5 percent to about 30 percent by weight of the dye and the negative charge control agent is present in amounts of from about 5 percent to about 0.1 percent by weight based on the weight of the particles to provide a charge/mass ratio of from 10 to in excess of 1,000 microcoulombs per gram depending upon the application for which it is to be used.

Although some prior art patents such as UK Patent Application No. GB 2 065 320 to Nashua and U.S. Pat. No. 3,363,863 to Veillette et al disclose charge control agents such as Laroflex-MP 35, this material is employed as an insoluble negative control agent. These patents along with U.S. Pat. No. 3,900,412 to Kosel and U.S. Pat. No. 4,374,918 to Veillette et al disclose a latex but the reasons for its use are radically different from that for the developer of this invention. Most of the other patents cited in the prior art statement are variations on the same theme with a wide range of polymers being used to colloidally stabilize and/or act as a fixant an/or contribute to charge in pigment developers.

The developer system of this invention is different from and has advantages over the prior art in many ways. For example, the sterically stabilized polymer particles are made in-situ using a polymerization method. Conventional developers are generally made by an attrition technique, i.e. breaking down of the pigment until the correct size is obtained. The polymerization method gives excellent control over particle size and size distribution which is missing from the attrition process. Moreover, in pigment based particles, the color imparted by the ink is related to the color of the pigment. Thus, there are a limited number of choices. In the particles of this invention, the latex is dyed. Since dyes can be mixed, there is much greater control over the color of the developer than is usually achieved with pigments.

Inks based on sterically stabilized polymer particles made in-situ are elegantly simple compared with pigment based inks and contain a minimum of additives. Pigment based inks appear to be getting more complex as more components are added in order to overcome deficiencies in these inks.

The liquid developers of this invention may be used in any suitable conventional liquid development electrostatographic imaging system. Thus, for example, the liquid developers of this invention may be used to develop conventional electrostatic latent images on xerographic, electrographic, and migration imaging (XDM) or other electrostatographic imaging members. Because of the resilient characteristics of the negatively charged marking particles in the developer of this invention, excellent adhesive transfer of deposited marking particle images to a receiving member may be effected with virtually no residual marking particles remaining on the original imaging surface. Moreover, the improved liquid developer compositions containing negatively charged toner marking particles are particularly adapted to be transferred from an imaging surface to a suitable adhesive surface. Typical adhesive surfaces are those found on common adhesive tapes such as Scotch brand adhesive tape available from 3M Company. The improved liquid developer compositions of this invention containing negatively charged toner marking particles may be utilized for developing positively charged electrostatic latent images or obtaining reversal images on negatively charged electrostatic imaging members which includes dielectric paper. Positively charged electrostatic latent images formed on dielectric paper by ion streams (ionography) have also been developed with the liquid developers of this invention. Thus, the liquid developers of the present invention may be utilized in the xerographic process or in other electrostatographic imaging systems including among others, electrographic recording, electrostatic printing, facsimile printing and the like. Accordingly, it should be appreciated that the description herein is applicable to liquid developers which may have utility in a variety of commercial embodiments.

A number of examples are set forth herein below that are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

75 ml of 2-ethyl hexyl methacrylate was dissolved in 300 ml of Isopar G. The solution was heated to 75° C. and purged with nitrogen for about 30 minutes. 0.8 gm of azobisisobutyronitrile was added to the solution and the polymerization allowed to proceed while being constantly stirred for about 16 hours at 75° C. to produce poly(2-ethyl hexyl methacrylate). 200 ml of this poly(2-ethyl hexyl methacrylate) solution was added to 500 ml of Isopar G. The solution was heated to 75° C. and purged with nitrogen for 30 minutes. 0.3 gm of benzoyl peroxide was added to the solution. After heating for an additional 30 minutes, 2.0 ml of vinyl pyrrolidone was added to the solution and polymerization was allowed to proceed at 70° C. further for 16 hours. A clear solution containing poly(2-ethyl hexyl methacrylate-g-N-vinyl-2-pyrrolidone) was obtained. 1 gm of azobisisobutyronitrile (AIBN) was then added to this solution followed, after an additional hour, by 230 ml of N-vinyl-2-pyrrolidone. The reaction was allowed to proceed at 70° C. for a further 16 hours under constant stirring. A latex of 0.2–0.6 micrometer particle diameter was obtained as evidenced by electron microscopy. The solid content of the latex was@20 percent weight-/volume.

The solids content of the resulting latex was adjusted to about 4 percent weight/volume by the addition of 400 ml of Isopar G to 100 ml of latex. A dyed methanol solution containing 1 g of Orasol Blue 2GLN in a 10 ml of absolute methanol was filtered through a Whatman No. 4 Filter Paper. The dyed methanol was then added drop wise to 100 ml of the 4% latex with constant stirring. The absorption process was carried out at 60° C. over a period of 3 hours after which the methanol was removed by distillation under a reduced pressure of 2 Torr and the resulting dyed latex filtered through a 45 micron wire sieve to remove any unwanted material. 2.7 mls of this dyed latex was diluted by the addition of 20 ml of Isopar G. To this dispersion was added 0.2 ml of polybutene succinimide (Chevron OLOA 1200, available from Chevron Chemical Company, San Francisco, CA) as charge control agent. This developer was employed to develop positively charged electrostatic latent images on a migration imaging member comprising migration (XDM) film. After development, the resulting toner image was removed from the migration imaging member by contacting the developer surface of the migration imaging member with 3M adhesive Scotch brand tape and thereafter transferred to a receiving member or ordinary paper. The transferred blue colored toner image exhibited a discernable resolution of greater than 10 line pairs/mm, an optical density of 1.0 as measured using a Macbeth densitometer, high density and excellent adhesion to paper after tape transfer. Other samples of this liquid developer were also stored in a polyethylene bottle and found to be colloidally and electrically stable for more than 3 months. The charge/-mass ratio of the toner was of the order of 100 $\mu C\ g^{-1}$.

EXAMPLE 2

500 ml of Isopar G was added to 125 ml of the poly(2-ethyl hexyl methacrylate) from Example 1. The resulting mixture was heated to 75° C. while being purged with nitrogen. 0.5 gm of benzoyl peroxide was then added to the solution. After heating for an additional 30 minutes, 5 ml of vinyl acetate was added to the solution and polymerization was allowed to proceed at 75° C. under constant stirring for an additional 16 hours. A clear solution of poly(2-ethyl hexyl methacrylate-g-vinyl-acetate) was obtained. 0.2 gm of AIBN was then added to the solution followed by 20 ml of vinyl acetate. The polymerization was allowed to proceed at 75° C. for a further 3 hours. 1.8 gm of AIBN was than added to this solution followed by a further 180 ml of vinyl acetate. The reaction was allowed to proceed at 75° C. for a further 18 hours under constant stirring. A latex of 0.3 micrometer particle diameter was obtained as evidenced by electron microscopy. The solid content of the latex was≈20 percent weight/volume.

The solid content of the resulting latex was adjusted to about 4 percent weight/volume by the addition of 400 ml of Isopar G to 100 ml of latex. A dyed methanol solution containing 1 g of Orasol Blue 2GLN in 10 ml of absolute methanol was filtered through a Whatman No. 4 Filter Paper. The dyed methanol was then added drop wise to 100 ml of the 4% latex with constant stirring. The absorption process was carried out at 60° C. over a period of 3 hours after which the methanol was removed by distillation under a reduced pressure of 2 Torr and the resulting dyed latex filtered through 45 $\mu$m wire mesh to remove any unwanted material. 40 mls of this dyed latex was diluted by the addition of 300 ml of Isopar G. To this dispersion was added 0.05 g of vegetable lecithin (Fisher Scientific Company) as charge control agent. This developer was employed to develop a positively charged electrostatic latent image on dielectric paper which was formed by an ion deposition technology breadboard. After development a blue image was obtained which exhibited an optical density greater than 1.0 with acceptable adhesion to the dielectric paper. The charge/mass ratio of this toner was of the order of 850 $\mu Cg^{-1}$.

EXAMPLE 3

300 ml of 2-ethylhexylacrylate was dissolved in 1200 ml of Isopar G. The solution was heated to 70° C. and purged with nitrogen for about 30 minutes. 3.92 gm of benzoyl peroxide was added to the solution and the polymerization allowed to proceed while being constantly stirred for about 6 hours at 70° C. to produce poly(2-ethyl hexyl acrylate). 70 ml of this poly(2-ethyl hexyl acrylate) solution was added to 125 ml of Isopar G. The solution was heated to 70° C. and purged with nitrogen for 30 minutes. 0.3 gm of AIBN was added to the solution. After heating for an additional 30 min., 3 ml of N-vinyl-2-pyrrolidone was added to the solution and polymerization was allowed to proceed at 70° C. further for 90 min to produce a graft copolymer solution of poly(2-ethyl hexyl acrylate-co-N-vinyl-2-pyrrolidone). 1.0 gm of AIBN was then added to this solution followed, after an additional 10 min. by 27 ml of N-vinyl-2-pyrrolidone. The reaction was allowed to proceed at 70° C. for a further 8 hours under constant stirring. A latex of 0.3 micrometer particle diameter was obtained as evidenced by electron microscopy. The solid content of the latex was=20 percent weight-/volume.

The solid content of the resulting mixture was adjusted to about 4 percent weight/volume by the addition of 400 ml of Isopar G to 100 ml of the latex. A dyed methanol solution containing 1 g of Orasol Blue 2GLN in 10 ml of absolute methanol was filtered through a Whatman No. 4 Filter Paper. The dyed methanol was then added drop wise to 100 ml of the 4% latex with constant stirring. The absorption process was carried out at 60° C. over a period of 3 hours after which the methanol was removed by distillation under a reduced pressure of 2 Torr and the resulting dyed latex filtered through glass wool to remove any unwanted material. 40 mls of this dyed latex was diluted by the addition of 300 ml of Isopar G. To this dispersion was added 0.5 g of basic barium petroleum sulfonate (Witco Barium Petronate B-70) as charge control agent. This developer was employed to develop positively charged electrostatic latent images on XDM film. After development the image was transferred from the XDM film using 3M Scotch brand adhesive tape to plain paper. The image was of a blue hue with an optical density greater than 1.0 and exhibited excellent fix characteristics to give a secure image. The liquid ink sample was stored in a polyethylene bottle and found to be electrically and colloidally stable over a period of more than 4 months. The charge/mass ratio of the toner was of the order of 350 $\mu Cg^{-1}$.

EXAMPLE 4

336 g of poly(isobutylene-co-isoprene) (Kalene 800, Hardman Co.) was dissolved in 1500 ml of Isopar G. The resulting mixture was heated to 75° C. while being purged with nitrogen. 3.6 gm of AIBN was then added to the solution. After heating for 15 min, 36 ml of ethyl acrylate was added to the solution and polymerization was allowed to proceed at 75° C. under constant stirring for an additional 3 hours. A clear solution of an amphipathic polymer of poly(isobutylene-co-isoprene-g-ethyl acrylate) was obtained. 15 gm of AIBN was then added to the solution. After heating for an additional 15 min. 324 ml of ethyl acrylate was added to the solution and polymerization was allowed to proceed at 75° C. further for 2 hours. 7.5 gm of AIBN was then added to this solution followed, after an additional 15 min by 120 ml of N-vinyl-2-pyrrolidone. The reaction was allowed to proceed at 70° C. for a further 16 hours under constant stirring. 3 gm of AIBN was then added to the solution and the polymerization continued for a further 5 hours at 80° C. A latex of 0.3 micrometer particle diameter was obtained as evidenced by electron microscopy. The solid content of the latex was≃28 percent weight/volume.

The solid content of the resulting mixture was adjusted to about≃4. A methanol solution containing 4 g of Orasol Yellow 2GLN dissolved in 20 mls of absolute methanol was filtered through a Whatman No. 4 Filter Paper. The dyed methanol was then added drop wise to 100 ml of the 4% latex with constant stirring. The absorption process was carried out at 60° C. over a period of 3 hours after which the methanol was removed by distillation under a reduced pressure of 2 Torr and the resulting dyed latex filtered through a 45 $\mu$m wire sieve to remove any unwanted material. 40 mls of this dyed latex was diluted by the addition of 300 ml of Isopar G. To this dispersion was added 0.5 g of barium petroleum sulfonate (Witco Barium Petronate B-70) as charge control agent. This ink was used to develop a positively charged latent image that was deposited on dielectric paper using an ion deposition breadboard. An excellent yellow image of optical density 0.9 was obtained which was well fixed to the paper.

EXAMPLE 5

The procedure described in Example 1 was repeated with identical materials except that polyisobutene succinimide (OLOA 1200, available from Chevron Chemical Company, San Francisco, CA) was substituted by vegetable lecithin as the negative charge control additive. The ink was found to give a blue image when toning a positively charged latent image produced by an ion deposition breadboard on dielectric paper. The optical density of the image was 1.1 with acceptable fixing to the paper. Upon storage in polyethylene bottles the ink was found to image well over a period of more than three months.

EXAMPLE 6

The procedure described in Example 1 was repeated with identical materials except that Orasol Yellow 2GLN was substituted for Orasol Blue 2GLN and vegetable lecithin was substituted for polyisobutene succinimide (Chevron OLOA 1200). The ink was found to image well onto migration imaging (XDM) film bearing an electrostatic latent image. The deposited image which was readily transferred using 3M Scotch brand adhesive tape to plain bond paper. The optical density of the image was 0.9 and was found to be securely fixed to the bond paper.

EXAMPLE 7

The procedure described in Example 1 was repeated with identical materials except that Orasol Red G was used in place of Orasol Blue 2GLN in the dyeing step and barium petroleum sulfonate (Witco Barium Petronate B-70) used as the charge control agent in place of polyisobutene succinimide (Chevron OLOA 1200). The resulting liquid ink developed a positively charged electrostatic latent image on XDM film, the resulting image was then readily transferred to plain paper using 3M Scotch brand adhesive tape to give a red image of optical density 1.0. The ink was found to be colloidally and electrically stable and imaged well after being left undisturbed in a polyethylene bottle for more than two months.

EXAMPLE 8

The procedure described in Example 1 was repeated with identical materials except that Orasol Red G was used in place of Orasol Blue 2GLN in the dyeing step. The resulting liquid ink developed a positively charged electrostatic latent image on XDM film, the resulting image was then readily transferred to plain paper using 3M Scotch brand adhesive tape to give a red image of optical density 1.0. The ink was found to be colloidally and electrically stable and imaged well after being left undisturbed in a polyethylene bottle for more than two months.

EXAMPLE 9

The procedure described in Example 1 was repeated except that ethyl acrylate was used in the dispersion polymerization to prepare the latex particle core instead of N-vinyl-2-pyrrolidone. Vegetable lecithin was used as the charge control agent instead of polyisobutene succinimide (Chevron OLOA 1200). The ink that was prepared was found to image well onto dielectric paper bearing a positively charged electrostatic latent image to form a blue image of optical density 1.1 and exhibited excellent adhesion to paper. Because of the softness of the core particle of the ink, it could not be tape transferred from XDM film to bond paper.

EXAMPLE 10

The procedure described in Example 9 was repeated except that Orasol Red G was used in place of Orasol Blue 2GN in the dying step. Basic barium petroleum sulfonate (Witco Barium Petronate B-70, available from Witco Chemical Company, New York, NY) was used as the charge control agent instead of vegetable lecithin. The ink that was prepared was found to image well onto dielectric paper to form a red image of optical density 1.0 and exhibited excellent adhesion to paper. Because of the softness of the core particle of the ink it could not be tape transferred from XDM film to bond paper.

EXAMPLE 11

The procedure described in Example 4 was repeated except that a mixture of dyes (1g Orasol Red G, 1g Orasol Yellow 2GLN, 1.4 g and 0.6 g Orasol Black RL) was used instead of the 4 g of Orasol Yellow 2GLN in the dying step. The ink that was prepared was found to develop a positively charged electrostatic latent image that was deposited on dielectric paper using an ion deposition breadboard. An excellent black image of optical density 1.2 was obtained which was well fixed to the dielectric paper.

EXAMPLE 12

The procedure described in Example 11 was repeated using vegetable lecithin as the charge control agent in place of barium petroleum sulfonate (Witco Barium Petronate B-70). The ink that was formulated was found to develop a positively charged electrostatic latent image formed on dielectric paper using an ion deposition breadboard. An excellent black image of optical density 1.2 was obtained which was well fixed to the dielectric paper.

EXAMPLE 13

The procedure described in Example 2 was repeated except that the vinyl acetate was replaced by a mixture of vinyl acetate (60 ml) and N-vinyl-2-pyrrolidone (120 ml) when synthesizing the latex. The ink, formulated as described in Example 2, was found to image well on dielectric paper carrying a positively charged electrostatic pattern which was formed using an ion deposition breadboard. The developed image was blue in color and exhibited an optical density of 1.0 with acceptable adhesion to the dielectric paper.

EXAMPLE 14

The procedure described in Example 13 was repeated wherein the ratio of vinyl acetate to N-vinyl-2-pyrrolidone used was 9:1 by volume. The ink formulated from this copolymer was found to image well on dielectric paper carrying a positively charged electrostatic latent image which was formed using an ion deposition breadboard. After development, a blue image was obtained which exhibited an optical density of 1.0 with acceptable adhesion to the dielectric paper.

Although the invention has been described with reference to specific preferred embodiments, it is not intended to be limited thereto, rather those skilled in the art will recognize that variations and modifications made be made therein which are within the scope of the invention and within the scope of the claims.

What is claimed is:

1. A stable colored liquid developer substantially free of pigment particles and substantially free of positively charged particles, said colored liquid developer comprising an insulating organic liquid dispersion medium having dispersed therein negatively charged, unipolar marking particles comprising a thermoplastic resin core substantially insoluble in said dispersion medium, an amphipathic copolymeric steric stabilizer irreversibly anchored to said thermoplastic resin core, said steric stabilizer being soluble in said dispersion medium and having a molecular weight of at least about 10,000, a colored dye imbibed in said thermoplastic resin core, said dye being soluble in said thermoplastic resin core, soluble in a polar solvent and insoluble in said dispersion medium, said polar solvent being insoluble in said insulating organic liquid, a charge control agent adsorbed at the interface of said marking particles and said insulating organic liquid dispersion medium, said charge control agent being selected from the group consisting of a polybutene succinimide, lecithin, basic barium petroleum sulfonates, and mixtures thereof, said charge control agent being present in an amount of from about 5 percent to about 0.1 percent by weight of said marking particles.

2. A stable colored liquid developer according to claim 1 wherein said charge control agent is polybutene succinimide dissolved in said insulating organic liquid.

3. A stable colored liquid developer according to claim 1 wherein said charge control agent is soluble in said organic insulating liquid.

4. A stable colored liquid developer according to claim 1 wherein said amphipathic copolymeric steric stabilizer is adsorbed at the interface between said organic liquid dispersion medium and said marking particles.

5. A stable colored liquid developer according to claim 1 wherein said insulating organic liquid comprises an aliphatic hydrocarbon having a resistivity of greater than about $10^9$ ohm cm.

6. A stable colored liquid developer according to claim 1 wherein said negatively charged marking particles have a diameter of from about 0.1 micrometer to about 1 micrometer.

7. A stable colored liquid developer according to claim 1 wherein said colored liquid developer has a solid content of from about 0.1 percent to about 2 percent weight/weight, each of said marking particles comprises from about 50 percent to about 98 percent by weight of said thermosplastic resin core and from about 50 percent to about 2 percent by weight of said stabilizer, and said thermoplatic resin core comprises from about 5 percent to about 30 percent by weight of said dye.

8. A process for preparing a stable colored liquid developer comprising preparing an amphipathic copolymeric steric stabilizer having a molecular weight between about 10,000 and about 100,000 in an insulating organic liquid dispersion medium, adding to said dispersion medium in the presence of a free radical initiator an excess of a resin forming polymerizable monomer, polymerizing said monomer to form resin cores substantially insoluble in said dispersion medium and to irreversibly anchor said amphipathic copolymeric stabilizer to said resin cores, preparing a solution of a colored dye in a polar solvent, said polar solvent being substantially insoluble in said insulating organic liquid dispersion medium, adding said solution of said colored dye in a polar solvent to said dispersion to imbibe said dye in said cores to form marking particles, said dye being soluble in said resin cores and insoluble in said dispersion medium, filtering said dispersion to remove any particulate matter to form a dispersion substantially free of pigment particles, and adding to said dispersion medium a charge control agent selected from the group consisting of a polybutene succinimide, lecithin, basic barium petroleum sulfonates, and mixtures thereof in an amount of from about 5 percent to about 0.1 percent by weight of said marking particles to form a stable colored liquid developer substantially free of pigment particles and substantially free of positively charged particles having dispersed therein negatively charged, unipolar marking particles.

9. An electrostatographic imaging process comprising providing an electrostatographic imaging member having a imaging surface, forming an electrostatic latent image on said imaging surface, applying a stable colored liquid developer substantially free of pigment particles and substantially free of positively charged particles, said colored liquid developer comprising an insulating organic liquid dispersion medium having dispersed therein negatively charged, unipolar marking particles comprising a thermoplastic resin core substantially insoluble in said dispersion medium, an amphipathic copolymeric steric stabilizer irreversibly anchored to said thermoplastic resin core, said steric stabilizer being soluble in said dispersion medium and having a molecular weight between about 10,000 and about 100,000, a colored dye imbibed in said thermoplastic resin core, said dye being soluble in said thermoplastic resin core, soluble in a polar solvent and insoluble in said dispersion medium, said polar solvent being insoluble in said insulating organic liquid, a charge control agent adsorbed at the interface of said marking particles and said insulating organic liquid dispersion medium, said charge control agent being selected from the group consisting of a polybutene succinimide, lecithin, basic barium petroleum sulfonates, and mixtures thereof, said charge control agent being present in an amount of from about 5 percent to about 0.1 percent by weight of said marking particles to said imaging surface whereby said negatively charged unipolar marking particles deposit on said imaging surface in conformance to said electrostatic latent image to form a marking particle image.

10. An electrostatographic imaging process according to claim 9 including transferring said marking particle image to a receiving member.

11. An electrostatographic imaging process according to claim 9 including transferring said marking particle image to an adhesive tape.

12. An electrostatographic imaging process according to claim 11 wherein said thermoplastic resin core has a glass transition temperature greater than about 35° C.

13. An electrostatographic imaging process according to claim 11 including applying said adhesive tape bearing said marking particle image to a receiving member to form a laminate in which said marking particle image is sandwiched between said adhesive tape and said receiving member.

* * * * *